US006123541A

United States Patent [19]

Yang

[11] Patent Number: 6,123,541

[45] Date of Patent: Sep. 26, 2000

[54] CHILDPROOF SAFETY DISPOSABLE LIGHTER

[76] Inventor: John Jiin Chung Yang, 154443 Proctor Ave., Suite B, Industry, Calif. 91745

[21] Appl. No.: 09/400,658

[22] Filed: Sep. 21, 1999

[30] Foreign Application Priority Data

Oct. 26, 1998 [CH] Switzerland ..... 98 2 42455

[51] Int. Cl.[7] ..... F23Q 2/46

[52] U.S. Cl. ..... 431/153; 431/144; 431/277

[58] Field of Search ..... 431/144, 153, 431/277, 255

[56] References Cited

U.S. PATENT DOCUMENTS 5,882,186 3/1999 Kai Man ..... 431/153

5,897,307 4/1999 Chang ..... 431/153

*Primary Examiner*—Carl D. Price

*Attorney, Agent, or Firm*—Raymond Y. Chan; David and Raymond

[57] ABSTRACT

A childproof safety disposable lighter includes a safety guide, which is coaxially to the striker wheel, having a smooth surface and elongating from the windshield and encircling both sides of the striker wheel. The radius of the safety guide is slightly greater than the radius of the contact wheel whereby the predetermined space will serve to inhibit the generation of sparks and flames.

2 Claims, 4 Drawing Sheets

CHILDPROOF SAFETY DISPOSABLE LIGHTER

BACKGROUND OF THE INVENTION

1. Field of Invention

The present invention relates to a disposable lighter, and more particularly to a childproof safety disposable lighter for preventing under age children from using the lighter.

2. Description of Related Arts

Commercially available disposable lighters are dangerous if they are handled carelessly, especially by young children. The inadvertent ignition of such disposable lighters may result in fires causing property damage and injury to people. Therefore, there is a need for a safety device that prevents inadvertent ignition of the disposable lighter, or makes the lighters difficult for children to operate. Disposable lighters are now required by federal law to contain ignition safety device in order to prevent young children from being able to ignite the lighters.

In response to the demands for a disposable lighter which is improved in safety in such a manner that inadvertent and unintentional ignition by those who are unfamiliar with the proper use of the lighter can surely be prevented. Childproof disposable lighters having different types of safety devices have already been known. Most of the safety devices built in these childproof disposable lighters have a lock mechanism which prevents depression of the actuating lever and must be released to allow the actuating lever to be depressed.

The most common kind of disposable lighter contains a safety device having an auto lock mechanism wherein a lock member automatically returns to the locked position in response to the ignition operation after the lock member has been manually moved to the released position. The operation of such safety device is unreliable because of a probability that the lock member will return to the locked position by its own reactive force due to the resilience of the material constituting the lock member. This adversely affects the ease of releasing the lock mechanism in a lighter, which is generally operated with a single finger, e.g. the thumb, and leads to different operational results depending on the users. Therefore, the conventional safety devices are disadvantageous in practical use.

In view of above, conventional childproof disposable lighters have drawbacks in practical use, and hence there has been a demand for a childproof safety device which is improved in both safety and operability.

Further, in manufacturing lighters with such a safety device, it is required to rationalize the assembling steps, to improve assembling accuracy, thereby further enhancing the handling of the safety device, and to reduce the manufacturing cost.

SUMMARY OF THE INVENTION

The main object of the present invention is to provide a childproof disposable lighter having a safety windshield for preventing under age children from using the lighter without adult's supervision.

Another object of the present invention is to provide a safety windshield for childproof disposable lighter, wherein the ignition of the lighter of the present invention requires a simple single-action operation by an adult's thumb instead of the conventional double-action operation.

Another object of the present invention is to provide a safety windshield for childproof disposable lighter, which is adapted to be installed to all kinds of the disposable lighter.

Another object of the present invention is to provide a safety windshield for childproof disposable lighter, which does not require to alter the original structural design of the disposable lighter, so as to minimize the manufacturing cost of incorporating the safety device with every conventional disposable lighter having a conventional striker wheel.

Another object of the present invention is to provide a safety windshield for childproof disposable lighter, wherein the shape of the disposable lighter is the same as an ordinary one that can keep the beauty shape of the lighter.

Accordingly, in order to accomplish the above objects, the present invention provides a safety windshield for a piezoelectric lighter which comprises:

a casing having a liquefied gas cavity;

a supporting frame, which is sealedly secured on top of the liquefied gas cavity, comprising two supporting walls parallelly and upwardly extended from a ceiling of the supporting frame;

a gas emitting valve having a nozzle upwardly extended from the ceiling of supporting frame and communicating with the liquefied gas cavity;

an actuating lever for actuating the gas emitting valve to release gas within the liquefied gas cavity, wherein the actuating lever is pivotally mounted between the two supporting walls of the supporting frame; and an ignition means comprising a flint supported by a resilient unit and a striker wheel, which is rotatably mounted between the two supporting walls of the supporting frame, comprising a spark wheel having a striking surface in contact with the flint and two driving wheels each having a diameter larger than that of the spark wheel, wherein the two driving wheels are integrally attached to two sides of the spark wheel coaxially, so that rotating the two driving wheels drives the spark wheel to rotate and strike against the flint to produce sparks directed toward the nozzle of the gas emitting valve.

The chrematistic is that the safety windshield comprises a U-shaped frame body having two sides respectively mounted on the two supporting walls of the supporting frame so as to position on the ceiling of the supporting frame. The safety windshield further comprises a pair of safety shells each of which is in circular shape provided at two sides of the U-shaped frame body of the windshield.

Each of the safety shells has a radius slighter larger than a radius of the driving wheels so as to encircle an outer side of the respective driving wheel to form a physical barrier to prevent a thumb of a child from fully engaging the striker wheel.

Thereby, in order to ignite the disposable lighter, an adult's thumb must intentionally depress the striker wheel downward until his/her finger's surface skin is completely on the contact surface of the driving wheels and spark wheel. Meanwhile, by rotating the spark wheel, a spark will be generated through the mutual friction of the striker wheel and the flint. At the same time, presses a depressable rear end of the actuator level down to create and maintain the flame.

DETAILED DESCRIPTION OF THE PREFERRED EMBODIMENT

Figure 1:
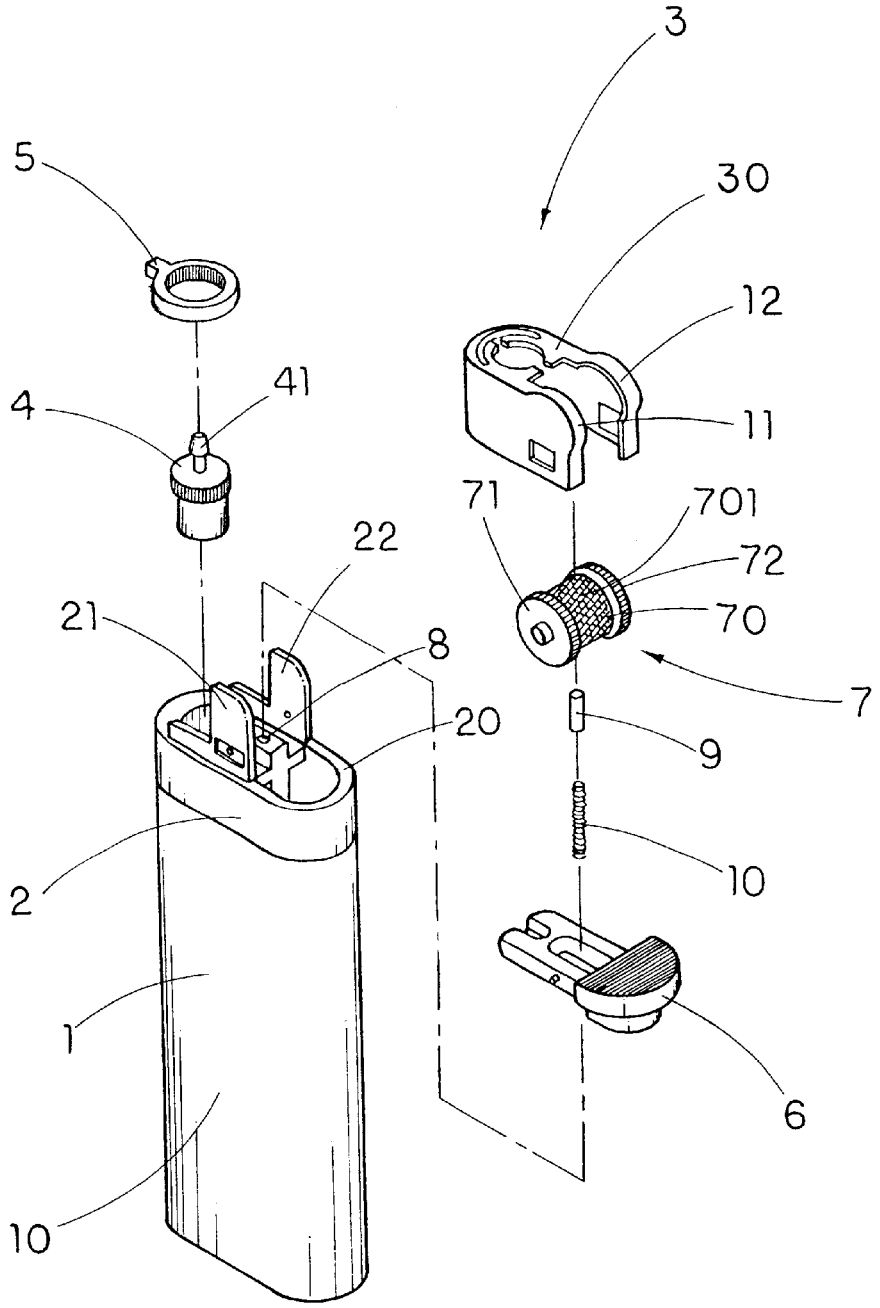
FIG. 1 is an exploded perspective view of a childproof disposable lighter according to a first preferred embodiment of the present invention.

Referring to FIG. 1 of the drawing, a childproof disposable lighter according to the first preferred embodiment is illustrated. The disposable lighter, which is illustrated as a cigarette lighter, comprising a casing 1 having a liquefied gas cavity 10, a supporting frame 2, which is sealedly secured on top of the liquefied gas cavity 10, comprising two supporting walls 21, 22 parallelly and upwardly extended from a ceiling 20 of the supporting frame 2, a safety windshield 3 mounted on the ceiling of the supporting frame 2, a gas emitting valve 4, which is actuated by an actuating lever 6 pivotally mounted between the two supporting walls 21, 22 of the supporting frame 2 for releasing gas therefrom, having a nozzle 41 upwardly extended from the ceiling 20 of the supporting frame 2 and communicating with the liquefied gas cavity 10, a flame regulator 5 encircling the gas emitting valve 4 and controlling the flow of gas through the gas emitting valve 4, a striker wheel 7 which is rotatably mounted between the two supporting walls 21, 22 of the supporting frame 2 comprising a spark wheel 70 having a striking surface 701 and two driving wheels 71, 72 each having a diameter larger than the spark wheel 70 being integrally attached tow two sides of the spark wheel 70 coaxially, a flint 9 and a resilient unit 10 received in a flint housing 8 wherein an upper portion of the flint 9 must be retained exposing outside the flint housing 8 and urging against the striking surface 701 of the spark wheel 70 of the striker wheel 7 by means of the resilient unit 10 for generating sparks directed toward the gas emitting valve 4 when the spark wheel 70 is driven to turn against the flint 9, the actuating lever 6 having a groove at its forward end engaging the nozzle 41 of the gas emitting valve 4 while a depressible end extending rearwards from the actuating lever 6 for enabling the depressing the depressible rear end for lifting up the gas emitting valve 4 for releasing gas.

Figure 3:
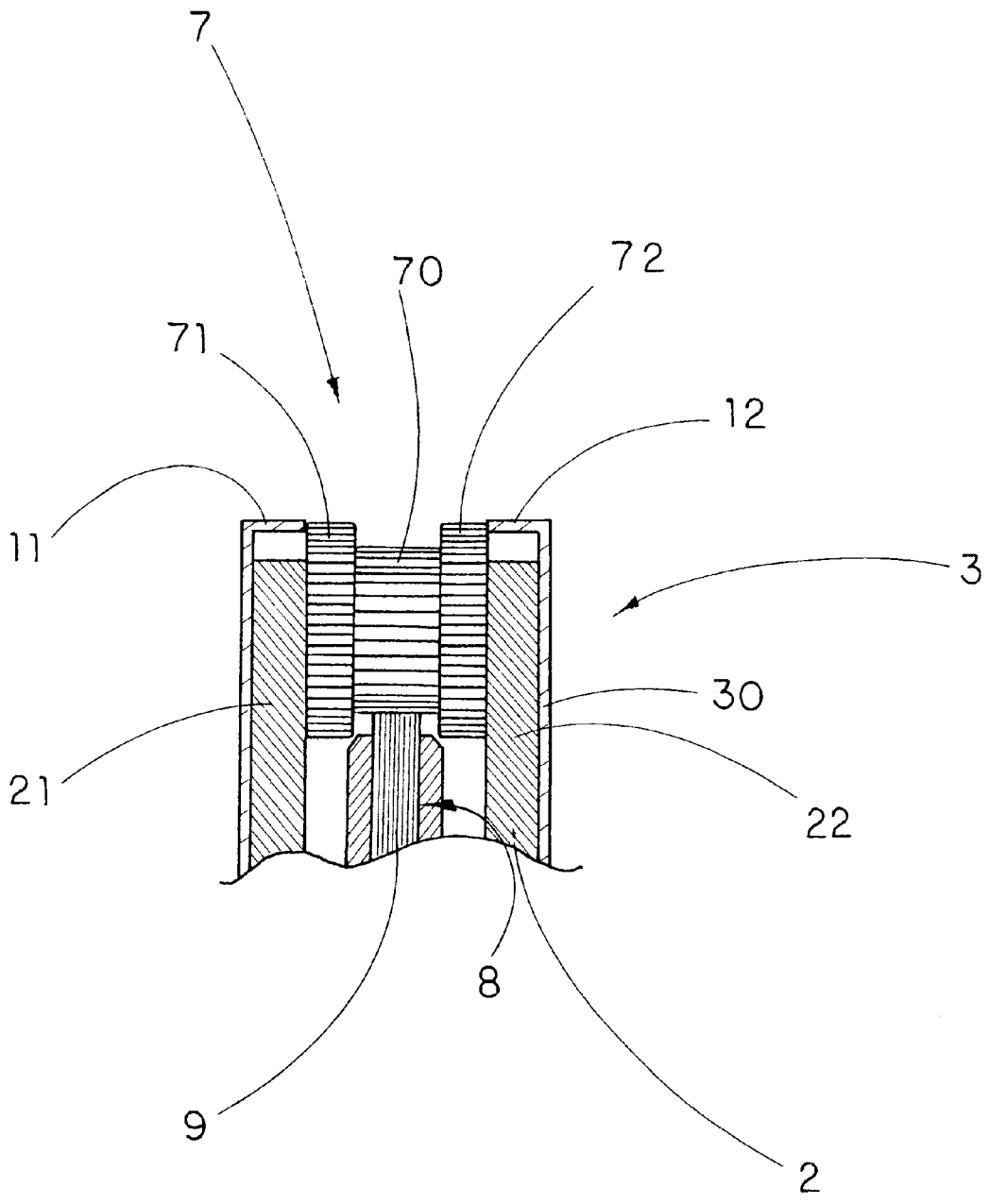
FIG. 3 is a cross-sectional view of the first above preferred embodiment of the present invention, illustrating the safety shell pieces.

The safety windshield 3 comprises a U-shaped frame body 30 having two sides respectively mounted on the two supporting walls 21, 22 so as to position on the ceiling 20 of the supporting frame 2. The safety windshield 3 further comprises a pair of safety shells 11, 12, each of which is coaxially with the striker wheel 7. The two safety shells 11, 12 are upwardly and rearwardly extended from the two sides of the U-shaped body 30 and facing the outer sides of the two driving wheels 71, 72 of the striker wheel 7 respectively. Each of the safety shells 11, 12 is in circular shape having a radius slightly larger than that of the respective driving wheel 71, 72 so as to encircle the outer sides of the driving wheels 71, 72 to form a physical barrier to prevent the user's thumb from fully engaging the striker wheel 7. The radius of the safety shell 11 is slightly larger than the radius of the striker wheel 7 wherein the difference between two radiuses is 0.1 mm. The position of the safety shell 11 is illustrated as shown in FIG. 3.

Furthermore, the surface of the safety shells 11, 12 is smooth. Since children have already known to rotate the striker wheel 7 of the lighter along a floor or other surface for striking amusing sparks and possibly flames, the smooth surfaces of the safety shells 11, 12 will serve to inhibit the generation of sparks and flames when the lighter is abused by children in such a manner. Moreover, for insufficient force, even adult's thumb will slip off the safety shell 11 without causing the rotation of the striker wheel 7 and operation of the lighter, so as to prevent unintentional ignition.

Figure 2:
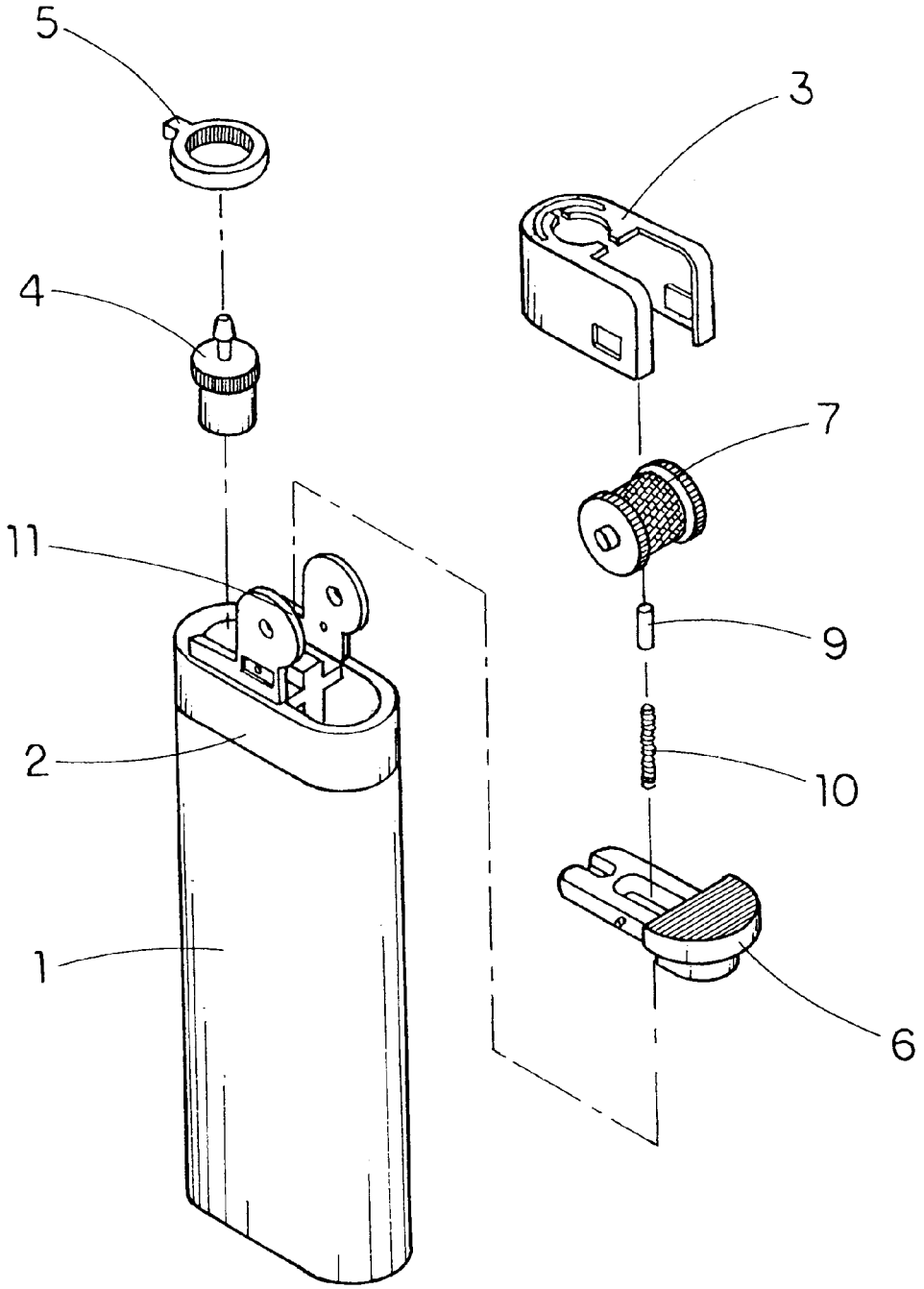
FIG. 2 is an exploded perspective view of a second preferred embodiment of the present invention.

Referring to FIG. 2 of the drawing, according to a second preferred embodiment of the present invention, the safety guide 11 is illustrated. The safety shell 11, which is coaxially to the striker wheel 7, is upwardly protruded from the supporting frame 2 and encircled the outer sides of the striker wheel 7. The radius of the safety shell 11 is the same as the radius of the striker wheel 7.

Figure 4:
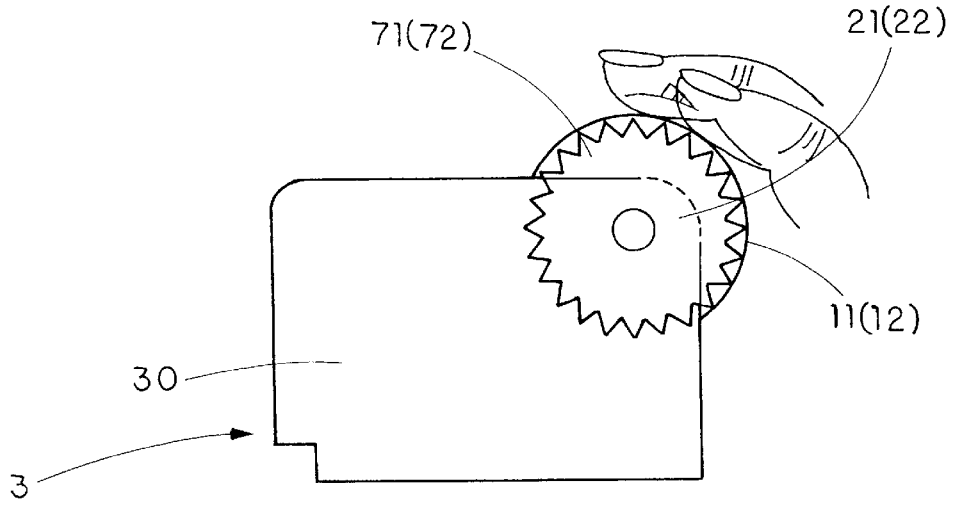
FIG. 4 is a perspective view of a childproof disposable lighter according to the above first preferred embodiment of the present invention, illustrating the slipping phenomenon of the safety shell pieces.
Figure 5:
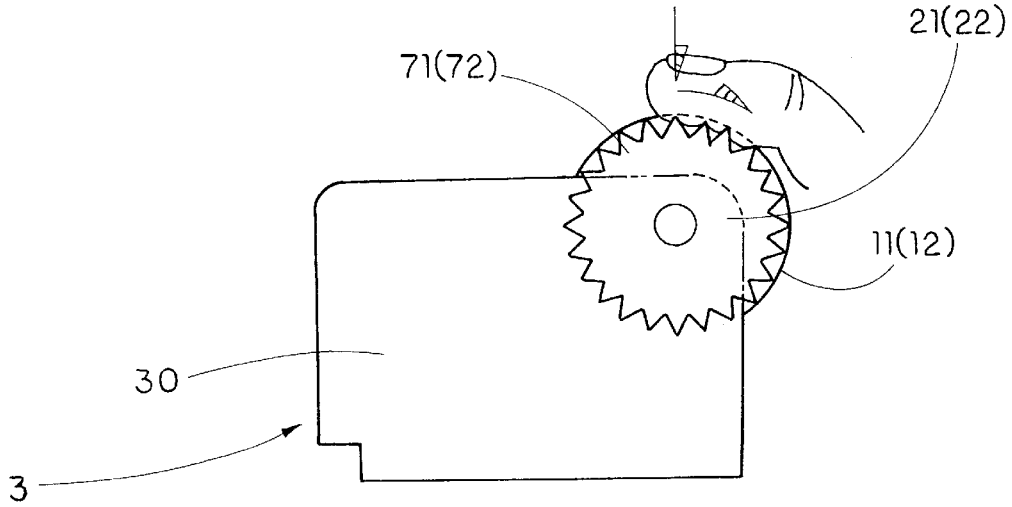
FIG. 5 is a perspective view of a childproof disposable lighter according to the above first preferred embodiment of the present invention, illustrating an adult's thumb intentionally depresses the striker wheel downward.

In order to ignite the disposable lighter of the above first preferred embodiment, referring to FIGS. 4 and 5, an adult's thumb must apply sufficient pressure on the striker wheel 7 and deform his/her thumb's surface past the safety shells 11, 12 to frictionally engage the driving wheels 71, 72 and the spark wheel 70 of the striker wheel 7 thereby rotating the striker wheel 7 as shown in FIG. 5. At the mean time, a spark is generated by the rotating striker wheel 7 and the depessable rear end of the actuating lever 6 will then be pushed downward for emitting gas. By releasing the depression of the striker wheel 7, the resilient unit 10, which is a compressed spring, will then rebound to regain its original form that upwardly pushes the flint 9 and the striker wheel 7 returning to their upper normal position instantly.

Furthermore, if an adult is not intentionally depress the striker wheel 7 or a child abuse the lighter, his/ her thumb will slip off the smooth surface of the safety shells 11, 12 as shown is FIG. 4. It is because his/ her thumb is not sufficient pressure to deform past the safety shells 11, 12 in order to engage and rotate the striker wheel 7. So, the disposable lighter of the present invention can prevent people from the misusing of the lighter.

According to the first and second preferred embodiments as disclosed above, the disposable lighter of the present invention can stop under age children from using the lighter by the limitation of their physical capability without any substantial change to the configuration of the lighter, so that the cost of the present invention is relatively inexpensive. No additional elements of such switching mechanism is required to incorporate with the disposable lighter for ensuring the safety feature thereof Therefore, the manufacturing procedure of the present invention is easy and in low cost.

What is claimed is:

1. A childproof disposable lighter, comprising:

a casing having a liquefied gas cavity;

a supporting frame, which is sealedly secured on top of said liquefied gas cavity, comprising two supporting walls parallelly and upwardly extended from a ceiling of said supporting frame;

a gas emitting valve having a nozzle upwardly extended from said ceiling of said supporting frame and communicating with said liquefied gas cavity;

an actuating lever for actuating said gas emitting valve to release gas within said liquefied gas cavity, wherein said actuating lever is pivotally mounted between said two supporting walls of said supporting frame;

an ignition means comprising a flint supported by a resilient unit and a striker wheel, which is rotatably mounted between said two supporting walls of said supporting frame, comprising a spark wheel having a striking surface in contact with said flint and two driving wheels each having a diameter larger than that of said spark wheel, wherein said two driving wheels are integrally attached to two sides of said spark wheel coaxially so that rotating said two driving wheels drives said spark wheel to rotate and strike against said flint to generate sparks directed toward said nozzle of said gas emitting valve; and a safety windshield comprising:

a U-shaped frame body having two sides respectively mounted on said two supporting walls so as to position on said ceiling of said supporting frame; and a pair of safety shells coaxially positioning with said striker wheel and facing two outer sides of said two driving wheels of said striker wheel respectively, said two safety shells being respectively extended integrally from said two sides of said U-shaped frame body upwardly and rearwardly, wherein each of said safety shells is in circular shape having an outer smooth surface and a radius slightly larger than that of said driving wheels so as to encircle said outer sides of said two driving wheels for, thereby, forming a physical barrier to prevent a thumb of a user from fully engaging said striker wheel.

2. A childproof safety disposable lighter, as recited in claim 1, wherein said radius of each of said safety shells of said safety windshield is 0.1 mm larger than a radius of each of said driving wheels.

* * * * *